US008539808B2

(12) United States Patent
Jones et al.

(10) Patent No.: US 8,539,808 B2
(45) **Date of Patent: *Sep. 24, 2013**

(54) BANDOLIER WITH LATERALLY OFFSET AND SPACED WORK PIECE

(75) Inventors: D. Patrick Jones, Sarver, PA (US); Michael Wayne Kelley, Sarver, PA (US); Richard Duane Pollick, Sarver, PA (US); Louis Carl Shaw, Saxonburg, PA (US); James J. Marraccini, Butler, PA (US)

(73) Assignee: Penn United Technologies, Inc., Cabot, PA (US)

( * ) Notice: Subject to any disclaimer, the term of this patent is extended or adjusted under 35 U.S.C. 154(b) by 80 days.

This patent is subject to a terminal disclaimer.

(21) Appl. No.: 13/366,570

(22) Filed: Feb. 6, 2012

(65) Prior Publication Data

US 2012/0137861 A1 Jun. 7, 2012

Related U.S. Application Data

(63) Continuation of application No. 12/728,618, filed on Mar. 22, 2010, now Pat. No. 8,176,826, which is a continuation-in-part of application No. 12/134,671, filed on Jun. 6, 2008.

(60) Provisional application No. 61/011,532, filed on Jan. 18, 2008.

(51) Int. Cl.
*B21J 11/00* (2006.01)

(52) U.S. Cl.
USPC ..... 72/404

(58) Field of Classification Search
USPC ..... 72/404, 405.01; 198/367.02, 367.11, 198/803.3, 803.14, 803.15
See application file for complete search history.

(56) References Cited

U.S. PATENT DOCUMENTS

| | | | | |
|---|---|---|---|---|
| 1,234,653 | A | 7/1917 | Gaynor | |
| 2,356,966 | A | 8/1944 | Bardell | |
| 3,407,463 | A | 10/1968 | Boots et al. | |
| 3,580,031 | A | 5/1971 | Donadio et al. | |
| 3,673,047 | A | 6/1972 | Buth et al. | |
| 3,766,825 | A | 10/1973 | Robinson | |
| 4,137,821 | A * | 2/1979 | Benedict | 198/803.15 |
| 6,018,860 | A | 2/2000 | Smith et al. | |
| 7,303,065 | B2 * | 12/2007 | Kaufman et al. | 198/803.7 |
| 2003/0115926 | A1 * | 6/2003 | Cutshall et al. | 72/404 |
| 2007/0214992 | A1 | 9/2007 | Dittrich | |

FOREIGN PATENT DOCUMENTS

| | | |
|---|---|---|
| CN | 1352740 | 6/2002 |
| CN | 1463354 | 12/2003 |

* cited by examiner

*Primary Examiner* — Teresa M Ekiert
(74) *Attorney, Agent, or Firm* — Eckert Seamans Cherin & Mellott, LLC; David C. Jenkins

(57) ABSTRACT

A method of operating a progressive die wherein the progressive die acts on a work piece having an elongated body with a blank at one end. The work piece is supported by a bandolier which is also formed in the progressive die. The progressive die acts on each blank.

5 Claims, 9 Drawing Sheets

BANDOLIER WITH LATERALLY OFFSET AND SPACED WORK PIECE

CROSS REFERENCE TO RELATED APPLICATION

This application is a continuation application of U.S. patent application Ser. No. 12/728,618, filed Mar. 22, 2010, entitled BANDOLIER WITH LATERALLY OFFSET AND SPACED WORK PIECE, which application is a continuation-in-part application of U.S. patent application Ser. No. 12/134,671, filed Jun. 6, 2008, entitled DUAL SIDED AND DUAL PROCESS BANDOLIER; which claims priority from U.S. patent application Ser. No. 11/206,256, which is now U.S. Pat. No. 7,383,760, issued Jun. 10, 2008, entitled BANDOLIERED FLECHETTES AND METHOD FOR MANUFACTURING BANDOLIERED FLECHETTES, which claims priority from U.S. Provisional Patent Application Ser. No. 60/602,480, filed Aug. 18, 2004, entitled BANDOLIERED FLECHETTES AND METHOD FOR MANUFACTURING BANDOLIERED FLECHETTES and U.S. Provisional Patent Application 61/011,532, filed Jan. 18, 2008 entitled, DUAL SIDED AND DUAL PROCESS BANDOLIER.

BACKGROUND OF THE INVENTION

1. Field of the Invention

This invention relates to an apparatus for manufacturing objects and conveying the same objects through a series of secondary operations and, more specifically, to such a process utilizing an offset bandolier.

2. Background Information

Many mass produced metal articles are created using a cold forming process. This process uses force, rather than heat, to form and/or shape parts into the desired configuration. Examples of cold forming processes include, but are not limited to, cold heading, cold roll forming, and other methods. Each of these methods is well known within the industry. Other methods of mass producing metal articles include various forms of machining.

Such production methods described above do not allow for the production rates that can be realized by producing products in a progressive die. A progressive die can allow the use of a bandolier, which is, generally, an elongated conveyor belt to which the raw material, or a partially completed work piece, may be removably coupled. Typically, the work piece is coupled to a retention member on the bandolier. The retention member positions the work piece above, and possibly laterally offset to, the centerline of the bandolier. Such dies may require a corrective device structured to laterally reposition the work piece. Work stations are disposed adjacent to, or above, the bandolier. As the bandolier advances, the various work stations each act upon one or more of the work pieces.

The positioning of the work stations depends upon the operation being performed on the work piece and/or the shape of the work piece. For example, in U.S. Pat. No. 7,383,760, noted above, a generally cylindrical segment of wire (the work piece) is formed into a flechette, or dart. Thus, one work station acts upon one end of the wire segment to form fins. A later work station acts upon the opposite end to form a point. Thus, these two work stations are disposed upon opposite sides of the bandolier. Other work stations may be bifurcated, that is, the work station may have components located on both sides of the bandolier. These components are structured to move over top of the bandolier to act upon the work piece.

As the bandolier progresses, typically in discrete "steps," the work piece progresses through the various work stations. It is noted that the work piece is not acted upon at each step. That is, a work piece may enter the first work station at the first progression. The bandolier may then advance several progressions before the work piece reaches the second work station. Such non-active steps, or "feed progressions," may be due to the fact that allowance is being made for future changes in the number, type, and/or location of the work stations, or, due to the fact that forming tools and equipment require a certain amount of space. It is further noted that a typical cold forming and machining process described above produces one part after another, but does not allow for subsequent secondary operations, such as heat treating, coating, assembly operations, etc.

The cold forming process described above may have inherent disadvantages. For example, in order for the various work stations to align properly with the work piece, the work piece must be in a known orientation relative to the bandolier. Typically, the work piece is oriented either laterally relative to the longitudinal axis of the bandolier, or the axis of the work piece extends normal, i.e. straight up, relative to the surface of the bandolier. However, when only one side of the work piece is acted upon, e.g. forming the fins on one end of a flechette, the work piece may become laterally offset relative the bandolier. Thus, the work piece must either be held in position at each work station, or, the work piece must be reoriented in between work stations.

As noted above, the work piece may be offset relative to the centerline of the bandolier. Such an offset has been, typically, fairly minor. For example, with the flechette described above, the "fin" side of the work piece typically extended further over the lateral edge of the bandolier than the "nose" side of the work piece. However, while the work piece could be offset, or shifted, to one side of the bandolier, at least a portion of the work piece was located over the bandolier.

SUMMARY OF THE INVENTION

The disclosed concept provides for an improved bandolier structured to support a work piece disposed to one side of the bandolier. That is, the work piece is offset and spaced from the bandolier. In this configuration, the various work stations acting upon the work piece may act upon, virtually, all sides of the work piece. This is different than the prior art wherein a work station could not act upon that portion of the work piece directly in contact with the bandolier. The disclosed method utilizes a work piece supported by a disposable stem. The stem is coupled to the bandolier and extends laterally thereacross. On one lateral end of the stem is the work piece, or "blank." The work piece is spaced from the bandolier thereby allowing work stations to act upon all portions of the work piece other than at the coupling to the stem. Once the work piece has been completed, including any secondary operations such as, but not limited to, a chemical dip or heat treatment, the work piece is decoupled from the stem.

It is further noted that the end of the stem opposite the work piece, hereinafter the "null end" of the stem may be used to orient the work piece. That is, during forming operations, the work piece and stem may become skewed relative to the axis of the bandolier. If this happens, the work piece may not be in the proper orientation to enter the next work station. An orienting structure, such as but not limited to a groove through which the null end travels, may be used to reorient the work piece and stem.

In the described embodiment, the work piece is an ammunition nose, hereinafter a "bullet," however the blank may be formed into any product and a bullet is merely used as an example. It is noted that in common parlance, the word "bullet" may be used to describe an entire cartridge, shell, or round, which actually includes a jacket and an explosive. However, as used herein, the "bullet" is only that portion of the round that is shot toward the target. The method of manufacture involves introducing a wire which acts as a work piece having a stem as well as a work piece blank disposed at one tip, and a strip, which is configured into a bandolier to carry the work piece, into one or more progressive work stations. The work piece is preferably made out of carbon steel or material of other similar properties. As the work piece enters each work station, the work stations will progressively form the work piece into the final product. Further, as set forth below, any number of secondary operations may be performed upon the bullet following forming. The bandolier can be made out of any material that has desirable forming properties. The bandolier will also be cold formed progressively in the die, and will be formed such that it clasps and retains the work piece and the stem. The bandolier will progressively carry the product through a series of forming operations within the die, and will also carry/convey the product through any desired secondary operations within the die, such as, but not limited to, grinding, shaving, polishing, cutting, etc. One of the final stations will have the ability to "loose piece" the work piece, that is, separate the work piece from the stem and the bandolier, or, will allow for the work piece to exit the final work station while still on the bandolier. In the case where the work piece and bandolier exit the die while coupled, the bandolier holding the work piece and stem can be conveyed to a series of additional secondary operations outside of the progressive die.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "work station" is a location along the path a bandolier travels wherein work is performed on a work piece. Multiple work stations may be disposed in a single machine, identified as a "progressive die," having a single operating mechanism, and/or, work stations may be disposed in two or more separate machines each having an independent operating mechanism, i.e., primarily the ram of a press, although other operating mechanisms such as motors used for rotary cutters as discussed below, may also be used.

As used herein, "progressive," when used in relation to the bandolier and dies, means a system wherein an elongated carrier advances at a regular, but intermittent, pace. Each cycle of movement followed by a stop is a "progression." During the movement portion of each progression, the carrier advances a set distance in the bandolier longitudinal direction. Thus, when the work pieces are coupled to the bandolier with a generally uniform spacing, each progression of the bandolier moves each work piece generally the same distance.

As used herein, an "effective step" identifies a step wherein a work piece coupled to the carrier is acted upon by a work station.

As used herein, an "idle station" is a location within the progressive die wherein a work piece may stop during a progression of the bandolier, but wherein no work is performed upon the work piece. For example, the progressive die may have twenty-five stations with ten work stations, wherein the work piece is acted upon, and fifteen idle stations, wherein the work piece is not acted upon. In such an exemplary progressive die, a bandolier would have to take twenty-five steps to advance a work piece through the progressive die.

As used herein, a "wire" that is fed into a progressive die includes an elongated, formable material having a cross-section that is typically circular, but which may have any shape, as well as, a series of individual segments that may be fed into the progressive die.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body.

As used herein, "configuration," as used in the phrase "different configurations" of the part created, includes parts having different shapes as well as different coatings, treatments, etc.

As used herein, "coin" means to alter the shape of a deformable body, typically a substantially metal body, using pressure, typically applied by one or more die components.

Figure 1:
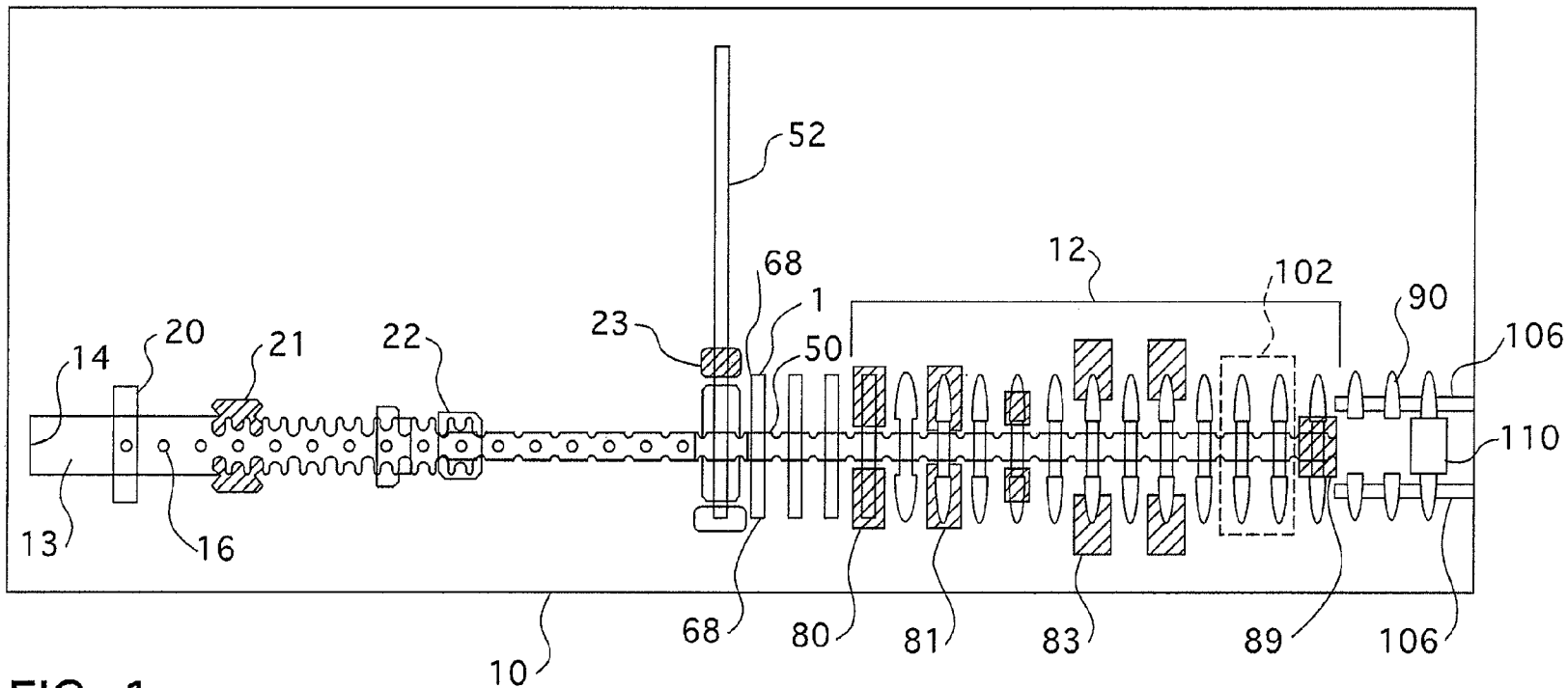
FIG. 1 is a top schematic view of a progressive die structured to act upon a dual sided work piece.

FIG. 1 shows a press 9 (shown schematically) that includes a progressive die 10 and an operating mechanism (not shown). The progressive die 10 (shown schematically) has a plurality of work stations 12 (all work stations 12 shown schematically). While specific work stations 12 are identified below and are related to the manufacture of bullets 90 (described below), it is understood that any type of work station 12 may be used with the disclosed method. Preferably, the operating mechanism 11 actuates the progressive die 10 during each progression of the bandolier 50, described below, causing the die components to move at each work station 12. That is, the operating mechanism 11 acts upon a common die set wherein all die components move at substantially the same time. However, it is noted that some work stations 12, although typically actuated by the operating mechanism 11, may be structured to move at a different time. By having a single operating mechanism 11, the chance of the work stations 12 becoming out of sync with each other is reduced. Generally, the work stations 12 are disposed on either side of a generally linear sheet of strip material 14, which becomes the bandolier 50, and are structured to perform an operation on a strip material 14 and/or on a work piece 1. Preferably, the work stations 12 used to form the bullets 90 and disposed on opposite sides of the bandolier 50 are structured to perform substantially the same operations at the same time to the work piece blanks 68 (described below).

It is further noted, a work station 12 may be structured to not operate, or not effectively operate, during each progression of the bandolier 50. That is, for example, a work station 12 may be structured to act upon two work pieces 1 disposed adjacent to each other on the bandolier 50. So as to not operate on the forward most work piece 1 twice, the work station 12 performs a null step when the first of the two work pieces 1 enters the work station 12. It is noted that the operating mechanism 11 may cause the work station 12 to move, but no effective operation is performed on the work piece 1.

Figure 2:
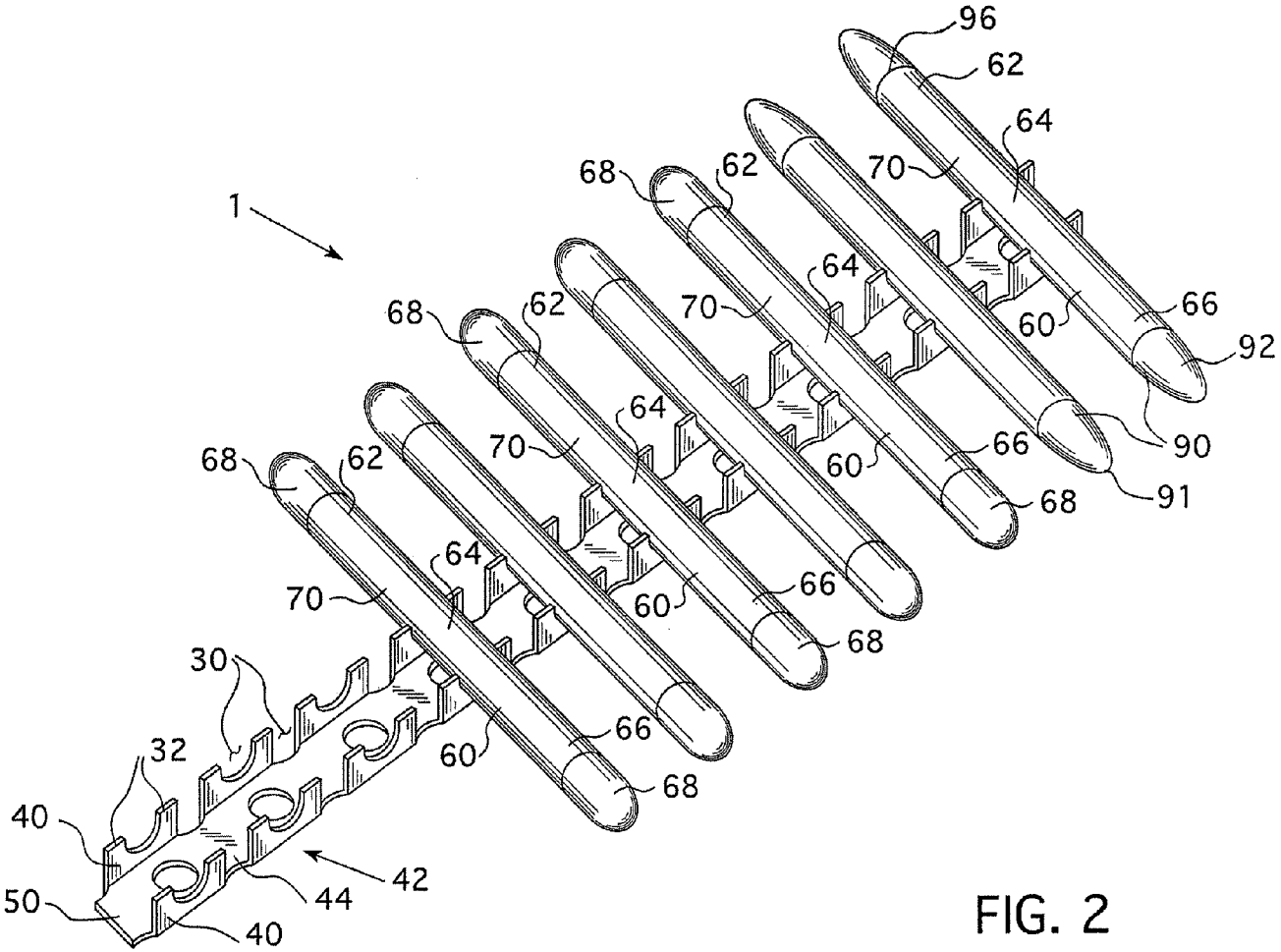
FIG. 2 is an isometric view of a section of a bandolier supporting dual sided work pieces.

As shown in FIG. 2, the bandolier 50 is similar to a conveyor belt in that the bandolier 50 is an elongated carrier that moves in the direction of its longitudinal axis and carries the work piece 1 between the work stations 12. Unlike a conveyor belt, the bandolier 50 does not form a loop and is, typically, not immediately reused/recycled after passing through the progressive die 10. In the preferred embodiment described herein, the bandolier 50 passes through a single progressive die 10. Typically, a single progressive die 10 maintains the bandolier 50, generally, in a single plane while the bandolier travels along a substantially linear path 51 through the progressive die 10. The bandolier 50, however, may be structured to be disposed at multiple different vertical levels while traveling in the generally linear path 51. For example, a bandolier 50 that travels through different presses and/or devices for secondary operations, as described below, may generally travel along a path 51 at a first upper level in the progressive die 10 while a portion of the bandolier path 51 extends to a lower level, e.g., to allow the bandolier 50 and the supported work pieces 1 to be dipped in a chemical bath during a secondary operation.

Figure 5:
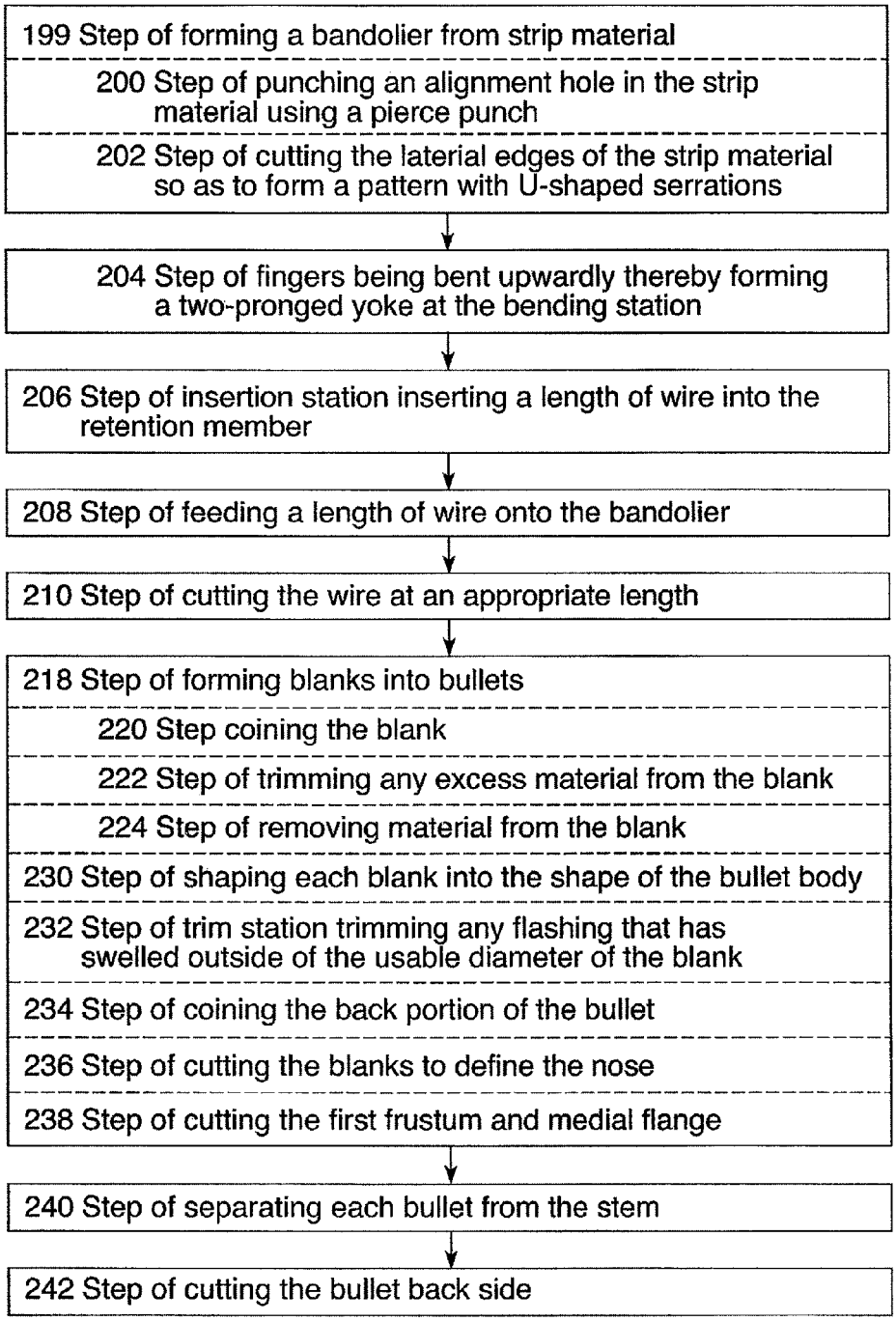
FIG. 5 is a flow chart of the steps associated with the method.
Figure 6:
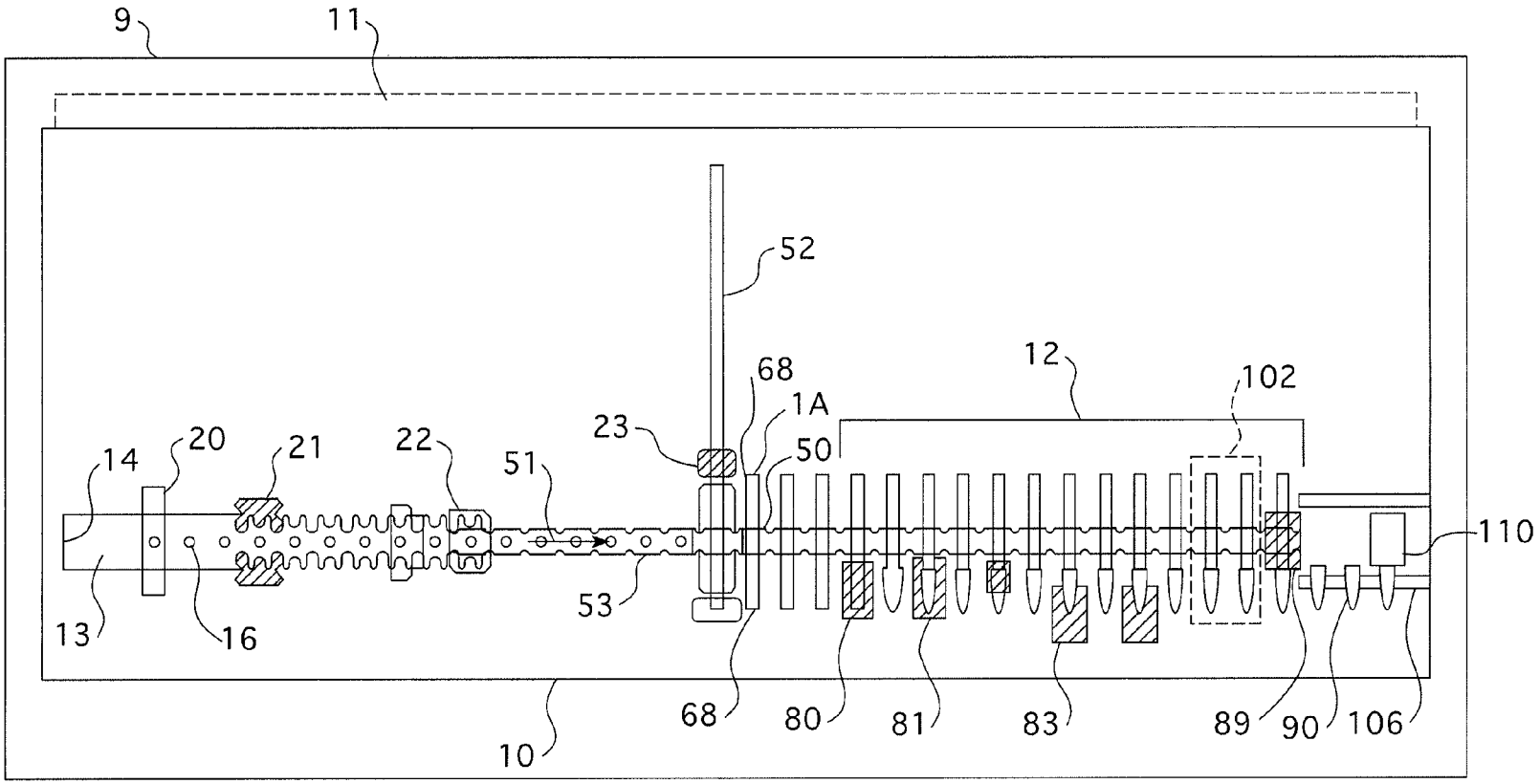
FIG. 6 is a top schematic view of a progressive die structured to act upon an offset work piece.
Figure 7:
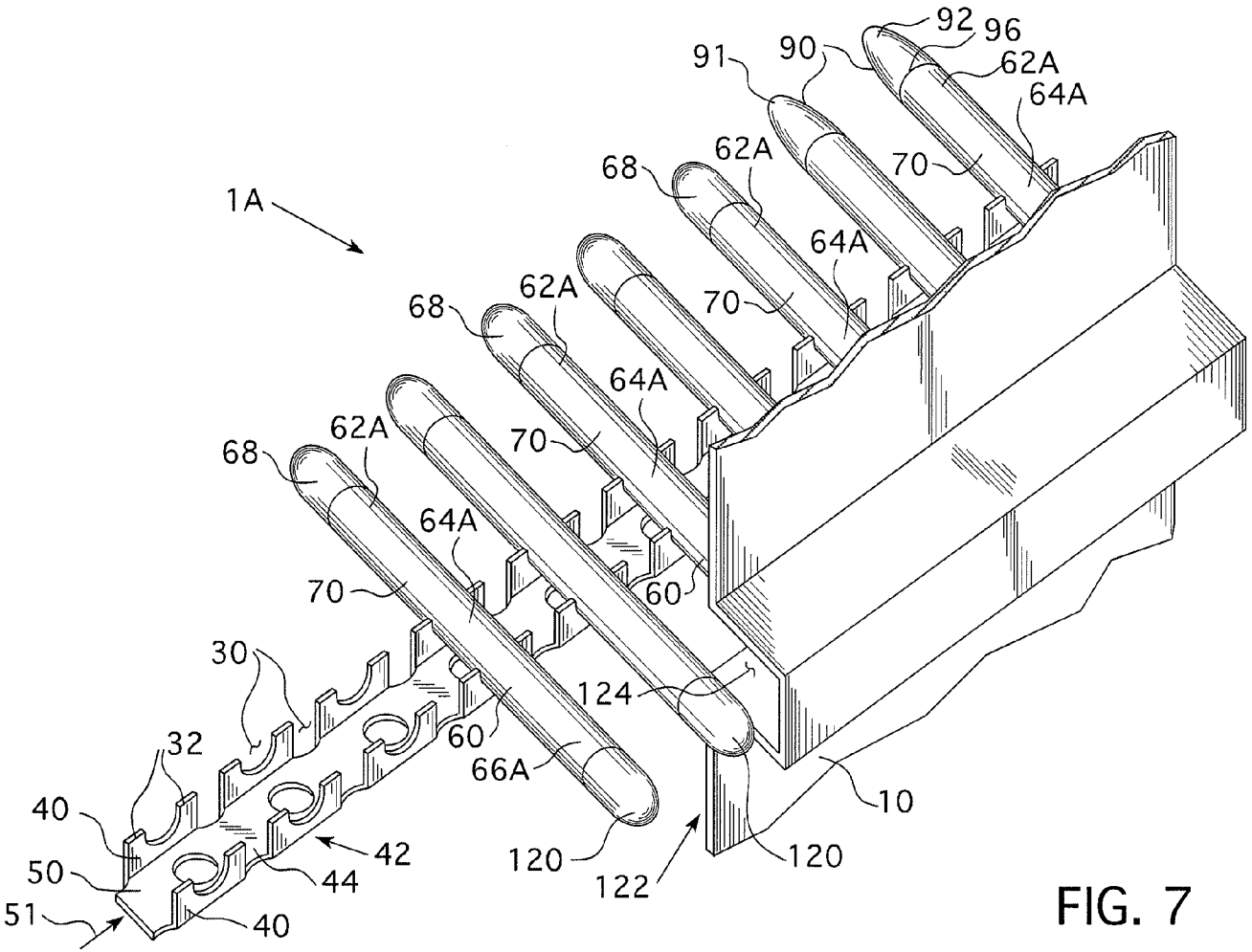
FIG. 7 is an isometric view of a section of a bandolier supporting offset work pieces and a groove acting as an orienting device.
Figure 8:
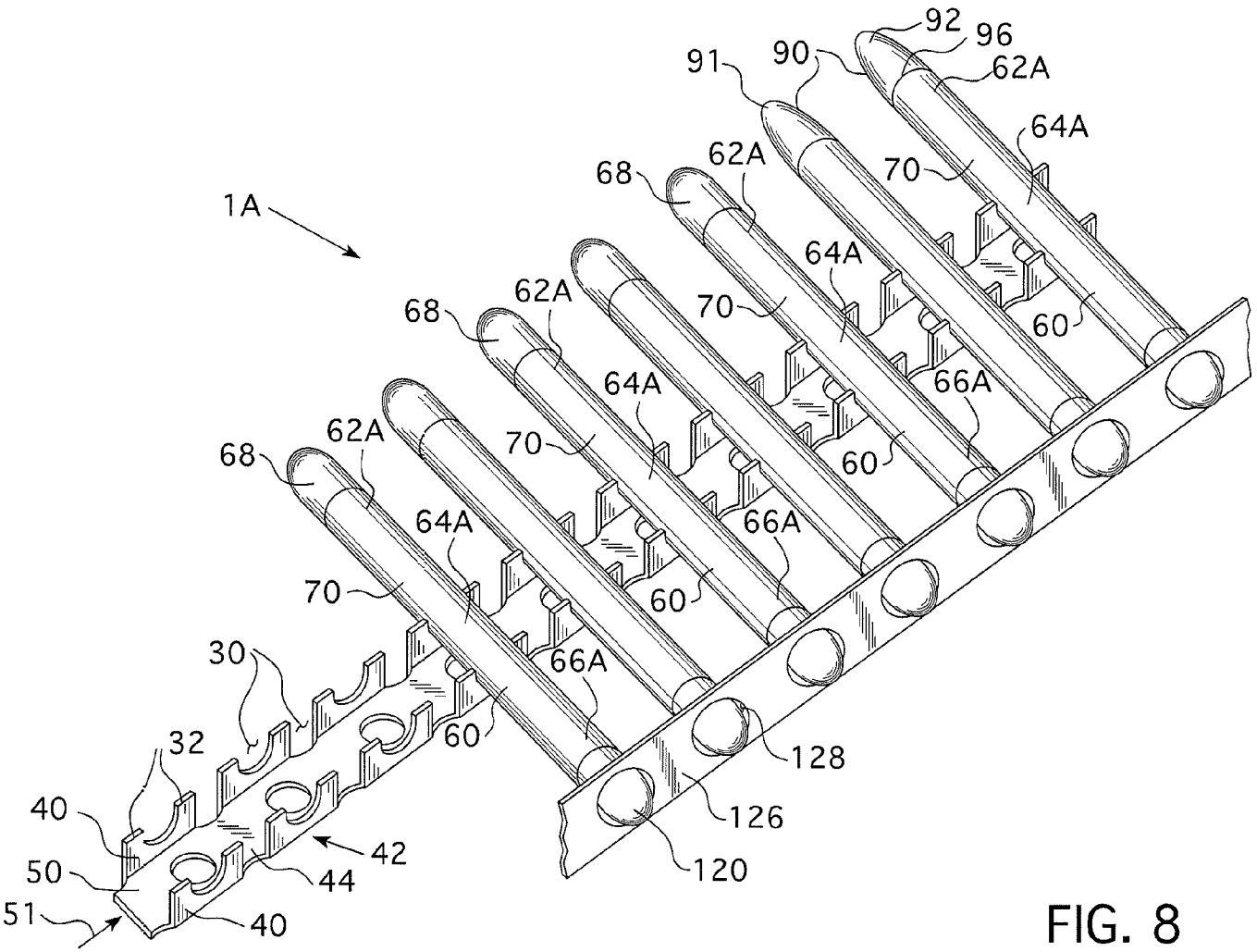
FIG. 8 is an alternate isometric view of a section of a bandolier supporting offset work pieces and a belt acting as an orienting device.

The following discussion shall address the various work stations 12 and identify the associated progression which the work station performs. All steps of the method are shown in FIG. 5. The bandolier 50 is formed 199 from a progressive die stock strip 13. The stock strip 13 begins as a generally flat sheet of strip material 14, such as, but not limited to, carbon steel. The strip material 14 enters the progressive die 10 and a first work station 12, which preferably includes a punch 20 (shown schematically). The first operation includes punching 200 an alignment hole 16 in the strip material 14 using a pierce punch that is mounted in the top portion of the die set (not shown). As the strip material 14 progresses, a pilot (not shown) having a cylindrical alignment rod, is passed through the alignment hole 16 to ensure proper strip alignment and progression. It is noted that at any station along the progressive die 10, a pilot step may be performed to ensure proper strip alignment and progression. Further, at any station along the progressive die 10, a camber adjustment operation may be performed. The camber adjustment operation entails mechanically adjusting the bandolier 50 to ensure that there is no incorrect twist inherent in the bandolier 50. Preferably, pilot steps and/or camber adjustment steps will occur just before the bandolier 50 enters an effective work station 12.

The strip material 14 progresses through a subsequent work station 12, which is preferably a trim work station 21, that creates the configuration that will eventually become the retention members 42 for retaining the work piece 1. For example, when the work piece 1 is initially an elongated stem 70 with end blanks 68, described below, both lateral edges of the strip material 14 are cut 202 so as to form a pattern with, preferably, U-shaped serrations 30, as shown. In between the U-shaped serrations 30 are slender fingers 32 of the strip material 14. The U-shaped serrations 30 and/or the fingers 32 on one side of the strip material 14 are aligned with the U-shaped serrations 30 and/or the fingers 32 on the other side of the strip material 14. Further, as described below, two adjacent and associated fingers 32 are bent upwardly to form a yoke 40. The U-shaped serration 30 between pairs of associated fingers 32 may extend a greater length toward the centerline of the strip material 14. The curvature of the U-shaped serrations 30 is sized to conform to the curvature of the stem 70, described below.

At a subsequent work station 12, a bending station 22, the fingers 32 are bent 204 upwardly thereby forming a two-pronged yoke 40. The portion of the strip material 14 that remains generally flat is a base 44 connecting the yokes 40. The combination of opposing yokes 40 in the strip material 14 acts as the retention members 42 for the described work piece 1. It is noted that for work pieces 1 of a different shape, the retention members 42 may have a different shape. Once the retention members 42 have been formed, the strip material 14 has been converted into the bandolier 50. Because the yokes 40 are aligned on opposite sides of the strip material 14, the axis of the retention members 42 extends generally perpendicular to the longitudinal axis of the bandolier 50. That is, an axis extending between the yokes 40 is generally perpendicular to the longitudinal axis of the bandolier 50. Further, in a preferred embodiment, each retention member 42 is disposed.

As the bandolier 50 progresses, a subsequent work station 12, an insertion station 23, inserts 206 a length of wire 52, preferably carbon steel, or another material of similar properties, into the retention member 42. In this example; the segmented wire 52 is the work piece 1 and is, preferably, a unitary body. In the preferred embodiment, the wire is supplied on a reel (not shown). As such, the insertion station 23 is structured to perform the steps of feeding 208 a length of wire 52 onto the bandolier 50, and cutting 210 the wire at an appropriate length.

The work piece 1 extends between, and is supported by, the two associated yokes 40. Thus, the longitudinal axis of the work piece 1 extends generally perpendicular to the longitudinal axis of the bandolier 50. The work piece 1 has an elongated body 60 with a first end 62, a medial portion 64, and a second end 66. The first and second ends 62, 66 are structured to act as blanks 68 upon which forming operations may be performed. The medial portion 64 acts as a stem 70 supporting the blanks 68. In this configuration, the blanks 68 are conveniently disposed at the lateral sides of the bandolier 50, wherein the blanks 68 may be acted upon by the work stations 12. It is noted that the stem 70 may have a reduced length, wherein the two blanks 68 are disposed generally over the bandolier 50, or, an extended length, wherein the stem 70 extends over the lateral sides of the bandolier 50 and supports the two blanks 68 in a laterally offset position relative to the bandolier 50. A reduced length stem 70 may require the work stations 12 to be adapted to move between a position over the bandolier 50, i.e., a work position, when the work piece 1 is in position, and a position to the side of the bandolier 50, i.e., a withdrawn position, to allow the work piece 1 to pass. However, a reduced length stem 70 also reduces the amount of scrap material created by the work piece 1. Conversely, an extended stem 70 may allow the work stations 12 to remain generally in one position on the side of the bandolier 50; however, an extended stem 70 increases the amount of scrap material created by the work piece 1.

As noted above, the work station 12 on opposite sides of the bandolier 50 preferably perform substantially similar actions to the work piece 1 and/or blanks 68. The opposing work stations 12 may be mirror images of each other. Because similar actions are being performed at substantially the same time to the blanks 68 on opposite sides of the work piece 1, the work piece 1 is less likely to shift within the retention member 42. That is, unlike a progressive die 10 having asymmetrical work stations 12, the work piece 1 is less likely to become laterally offset relative to the longitudinal axis of the bandolier 50. Thus, the progressive die 10 may be structured to operate without a corrective device structured to laterally reposition the work piece 1. Hereinafter, only a single work station 12 is described; however, it is understood that a substantially similar work station 12 is disposed on the opposite side of the bandolier 50. It is further understood that opposing work stations are actuated 212 substantially simultaneously.

With the work piece 1 in position on the bandolier 50, the progressive die 10 moves each work piece 1 through the desired work stations 12 in a progressive manner. Generally, the blanks 68 are formed 218 into bullets 90 which have a nose 91, a body 92, and a back side 96. The bullet body 92 is generally cylindrical, or frustum, shaped. The blanks 68 are formed 218 into bullets 90 by being "coined," i.e. deformed under pressure, by being "trimmed," i.e. having excess material created by the coining removed, and by being "cut" wherein the work piece 1 and/or blank 68 material is removed.

Thus, the apparatus and method include at least one work station 12 structured to reshape 219 the blank 68, and more specifically, two opposed work stations 12 structured to reshape 219 both blanks 68 disposed on opposite ends 62, 66, of the work piece 1. Preferably, the work stations 12 include at least one coining station 80 structured to coin 220 the blank 68, and, at least one trim station 81 structured to trim 222 any excess material or "flashing" from the blank 68, and, preferably, at least one cutting station 83 structured to remove 224 material from the blank 68. Any one of the coining station 80, the trim station 81, or the cutting station 83, may be the at least one work station 12 structured to reshape the blank 68. For example, the step of coining 220 the blank 68 may, by itself, shape the blank 68 into a bullet 90. Typically, however, at least some material of the blank 68 must be removed 224 from the blank 68 to finish the bullet 90. Further, coining operations may create flash lines where the coining dies (not shown) meet. Therefore, a step of trimming 222 the flashing from the blank 68 is also typically required. The progressive die 10 may include other work stations 12, and the method may provide for additional corresponding steps, such as, but not limited to, additional coining, trimming, and cutting. Further, if the finished part is not symmetrical about a centerline, a work station 12 may be configured to rotate the work piece 1 about its axis or reorient the work piece 1, so that different areas of the work piece 1 may have different operations performed thereon.

As noted above, in an alternate embodiment, the work stations 12 disposed on opposite sides of the bandolier 50 may be different and may be employed to create different parts. Again, using bullets 90 as an example, two opposing work stations may include one work station 12 structured to create .22 caliber bullets 90 while the opposing work station 12 is structured to create .45 caliber bullets 90. Thus, the work piece 1 may be altered so that the blank 68 at the first end 62 first end has one configuration and the blank 68 at the second end 66 has a different configuration.

Figure 3:
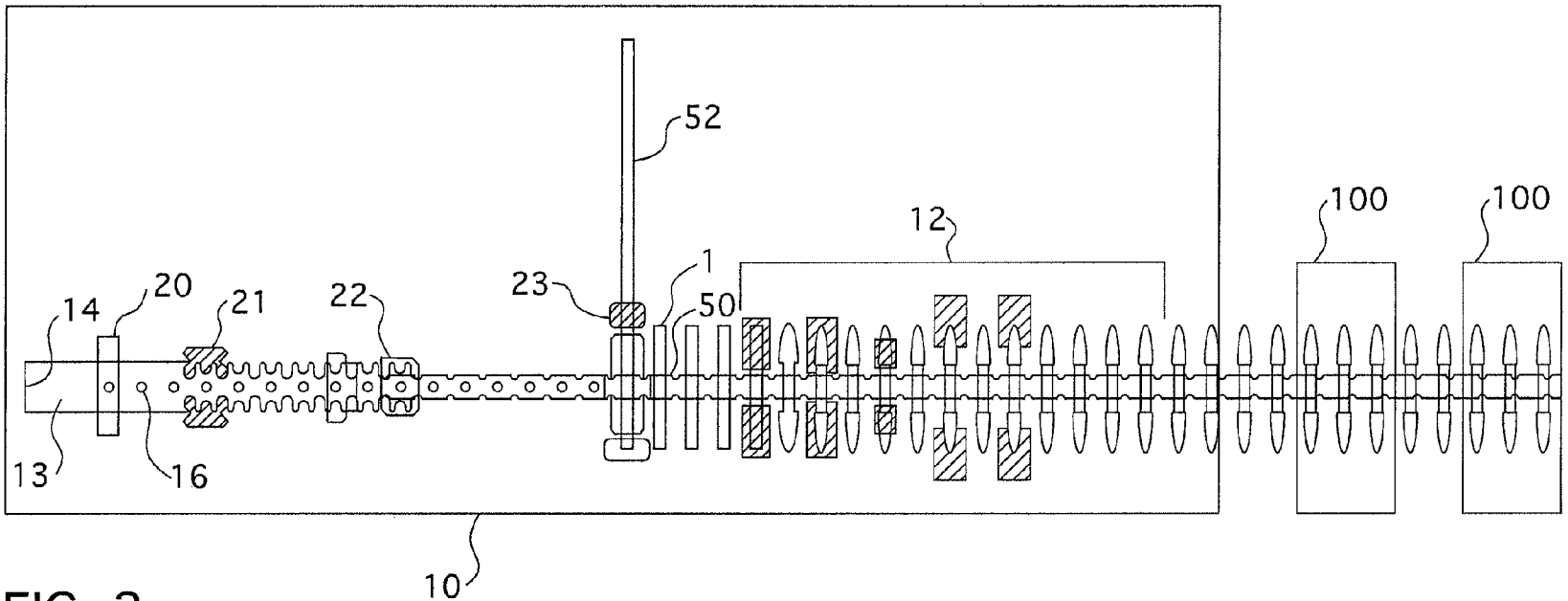
FIG. 3 a top schematic view of a progressive die structured to act upon a dual sided work piece and having other devices for secondary operations.

At this point, the work piece blanks 68 have been, substantially, converted into bullets 90, but are still coupled to the stem 70. This may be the desired result of the progressive die 10 as the combination of work pieces 1 disposed on a bandolier 50 may be coiled for transport between the progressive die 10 and other processing devices 100, or the bandolier 50 with work pieces 1 may be fed directly into the other processing devices 100, as shown in FIG. 3. The other processing devices 100 will typically be structured to perform processes selected from the group comprising, but not limited to: cleaning, coating, and heat treating. It is noted that the other processing devices 100 may include other devices structured to further reshape the bullets 90. For example, the bullet back side 96 may be reshaped so as to not be flat.

However, in the preferred embodiment (FIG. 1), the bullets 90 are separated from the stem 70 prior to exiting the progressive die 10. Thus, the progressive die 10 preferably includes a "loose piece" station 89 structured to separate 240 each bullet 90 from the stem 70. Preferably, the loose piece station 89 creates a substantially flat back side 96 for each bullet 90. At this point, the bandolier 50 and the stem 70 have served their purpose and may exit the progressive die 10 to be recycled. The loose bullets 90 may be made ready for further processing or for sale.

Figure 4:
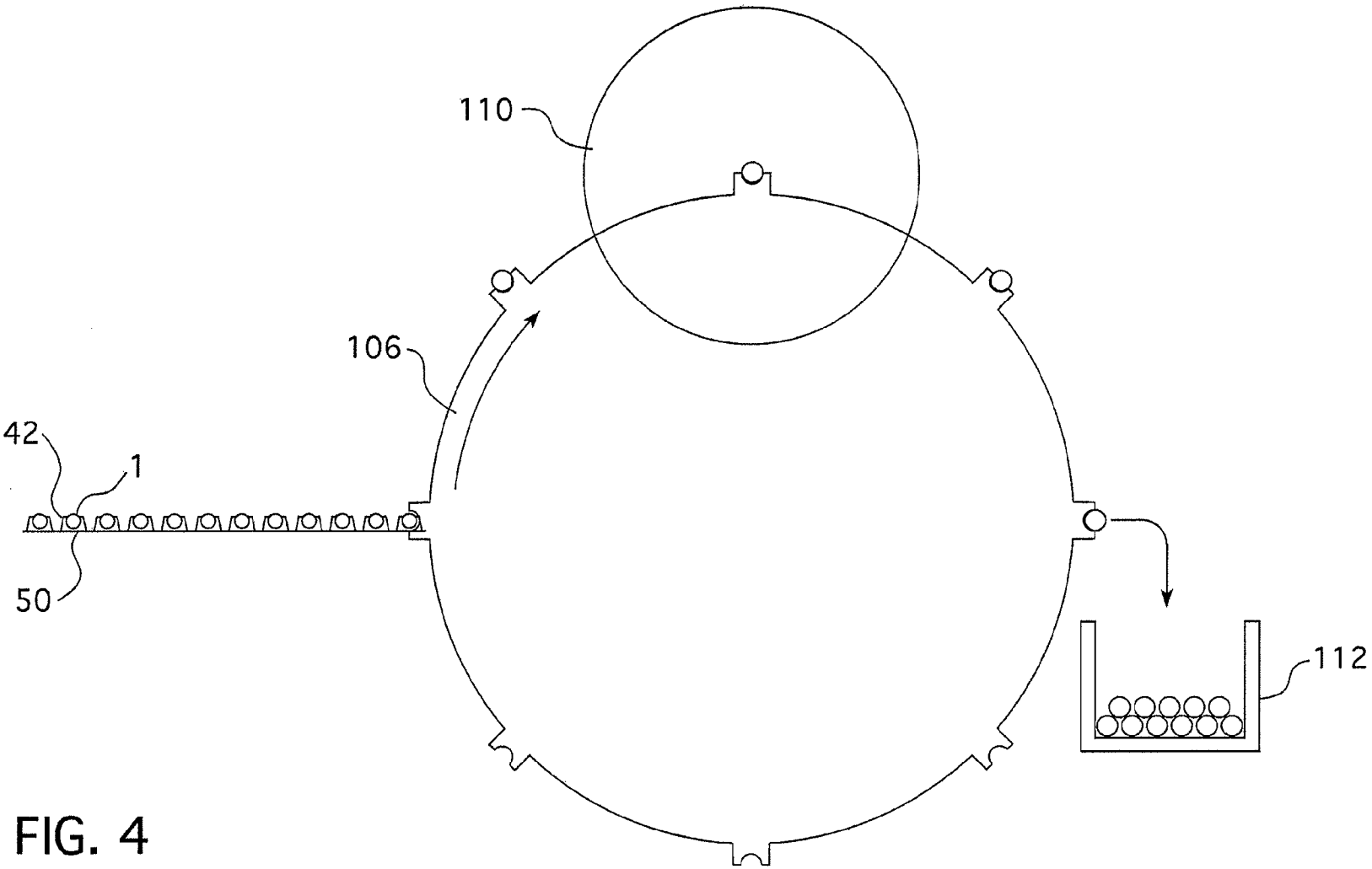
FIG. 4 is a detailed side schematic view of a progressive die having a rotary holding fixture.

If the loose piece station 89 does not create a flat back side 96, the bullet back side 96 may require additional processing to form the substantially flat back side 96. Thus, as shown in FIG. 4, the progressive die 10 may include a holding fixture 106, as shown, a rotary holding fixture 107 but any holding fixture 106 may suffice. The holding fixture 106 is structured to support the bullets 90 after separation from the stem 70 and to transport the bullets 90 to one or more subsequent work stations 12. As shown, a subsequent work station 12 may be a rotating cutting station 110 structured to cut 242 the bullet back side 96 so that the bullet back side 96 is substantially flat. Alternatively, the subsequent work station may perform operations such as, but not limited to, cutting a champher on the bullet back side 96, machining a passage (not shown) through, or substantially through the bullet 90, applying another material in such a passage, applying a coating to the bullets 90, as well as additional finishing operations. After the back side 96 is cut, the loose bullets 90 may be made ready for further processing or for sale.

It is further noted that, the blanks 68 may be formed into cooperative components. That is, two components, which may or may not be substantially similar, may be structured to be joined after the forming is complete. Thus, while typically not applicable to bullets 90, the blanks 68, or the components formed therefrom may be coupled at a subsequent work station 12 after the separation 240 from the stem 70.

While use of a dual sided work piece 1 has the advantage of producing twice as many parts as a single sided work piece 1A, the certain concepts disclosed above may also be incorporated advantageously with a one-out process. More specifically, the use of a stem 70 to support a blank 68 at a location offset and spaced from the bandolier 50 is advantageous. Such a configuration allows the various work stations 12 to act upon, virtually, all surfaces of the blank with the exception of the point where the stem 70 is coupled to the blank 68. Such a configuration may be used, for example, in a situation where a press 9 included different types of work stations 12 on opposite sides of the bandolier 50 and structured to produce different types of products, but, where more of one type of product is needed. Rather than produce extra units of the unneeded product, a work piece 1A with a single blank, that is offset and spaced from the bandolier 50, is used. As a further example, a manufacturer may only have work stations 12 sufficient to operate on one side of the bandolier path 51. Hereinafter, the side of the bandolier 50 on which the work stations 12 are located shall be identified as the work side 53 of the bandolier 50. Thus, there is also a use for a single sided work piece 1A wherein the work piece 1A is structured to support the blank 68 at a location offset and spaced from the bandolier 50.

Generally, the single sided work piece 1A, and an associated press 9 and progressive die 10, are configured and operate in a manner substantially similar to the dual sided work piece 1, and an associated press 9 and progressive die 10, with the obvious exception of having only one blank 68. That is, the single sided work piece 1A extends between, and is supported by, the two associated yokes 40 on the bandolier 50. Thus, the longitudinal axis of the single sided work piece 1A extends generally perpendicular to the longitudinal axis of the bandolier 50. The single sided work piece 1A has an elongated body 60A with a first end 62A, a medial portion 64A, and a second end 66A. The first end 62A is structured to act as a blank 68 upon which forming operations may be performed. The medial portion 64A acts as a stem 70 supporting the blank 68. In this configuration, the blank 68 is conveniently disposed, and spaced from, the bandolier work side 53. This allows for the work stations 12 to act upon virtually all surfaces of the blank 68. Preferably, when the work piece 1A is coupled to the bandolier 50, the first end blank 68 is spaced between about 0.015625 inch (1/64 inch) and 12.0 inches from the bandolier work side 53, and more preferably about 0.125 inch (1/8 inch) from the bandolier work side 53.

It is further noted that the work piece 1A may include an orienting structure 120. As noted above, when only one side of a work piece 1A is acted upon by the work stations 12, the work piece 1A may become skewed relative to the bandolier 50. When a work piece 1A is skewed, the blank 68 is likely to be unaligned with the work stations 12. Thus, it is desirable to minimize, or preferably prevent, skewing of the work piece 1A. Skewing may be substantially reduced by utilizing the second end 66A to assist in orienting the work piece 1A. The orienting structure 120 is structured to cooperate with an orienting device 122 disposed on the side of the bandolier path 51 opposite said work stations 12. Preferably, the orienting device 122 is incorporated into the progressive die 10.

For example, in one simple form, the work piece second end 66A, that is, the orienting structure 120, is unmodified but structured to travel through a longitudinal groove 124, that is, the orienting device 122 is the groove 124. The groove 124, which may not be continuous, extends in a direction parallel to, and adjacent to, the bandolier path 51. The groove 124 is slightly wider than the work piece second end 66A and may have a wide, preferably tapered entrance. The groove 124 is, preferably, sufficiently deep so that the work piece second end 66A cannot contact the bottom of the groove 124. Thus, the work piece second end 66A may travel through the groove 124 without interference. As the work piece 1A travels through the progressive die 10, the blank 68 disposed at the work piece first end 62A may be acted upon by the work stations 12. At the same time, the work piece second end 66A, that is, the orienting structure 120, is disposed in, and travels through, the groove 124. If a work station 12 biases the work piece 1A in a vertical direction and starts to skew the work piece 1A vertically, the orienting structure 120 will engage the groove 124 and, substantially prevent the work piece 1A from skewing vertically.

The orienting device 122 may be more complex as well. For example, the orienting device 122 may also include a belt 126 structured to travel through the groove 124. Such a belt 126 has a plurality of openings 128 sized to be slightly larger than the work piece second end 66A. The belt 126 may be operatively coupled to the press 9 operating mechanism 11 and structured to advance in synchronicity with the bandolier 50. In this configuration, the work piece second ends 66A are each structured to be disposed within a belt opening 128. Thus, if a work station 12 biases the work piece 1A in a vertical and/or horizontal direction and starts to skew the work piece 1A, the orienting structure 120 will engage the belt 126 and, substantially prevent the work piece 1A from skewing.

Figure 9:
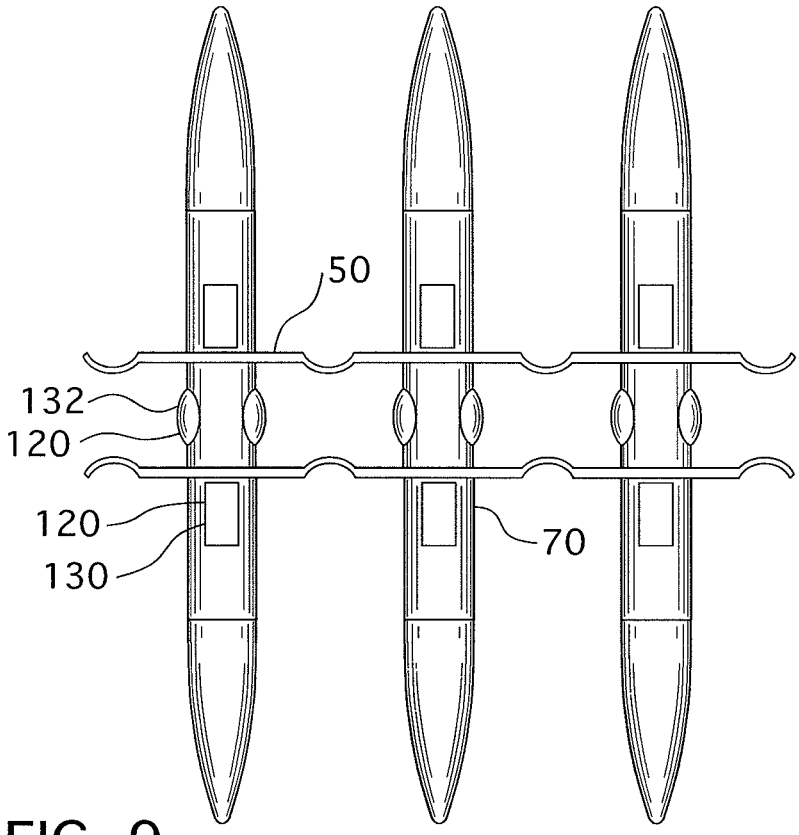
FIG. 9 is a detailed view of a workpiece having orientation devices.

In another embodiment, the orienting structure 120 may be structured to be manipulated by one or more work stations 12. Thus, the orienting structure 120 may be shaped to have a more complex interaction with an orienting device 122. For example, as shown in FIG. 9, the orienting structure 120 may be, but is not limited to, a flat 130 coined into the stem 70, a bore hole cut partially through the stem 70 (not shown), an opening (not shown) extending through the stem 70, or a flat, vertical fin 132 coined into the stem 70. It is noted that FIG. 9 shows the fins 132 disposed within the area defined by the bandolier 50 and the flats 130 disposed outside the bandolier 50; these locations are exemplary only and the orienting structure 120 may be disposed at any location on the stem 70. Further, as shown, there are two flats 130 disposed on opposite lateral sides of the stem 70 and two fins 132 disposed on opposite radial sides of the stem 70. There may be, however, any number of orienting structures 120 on the stem 70. It is noted that one common configuration would have four orienting structures 120 disposed ninety degrees apart. Further, and as shown in FIG. 9, the orienting structure 120 may be used on the dual sided workpiece 1 as well.

Such an orienting structure 120 may cooperate with a shaped portion (not shown) of the groove 124 or other orienting device 122. That is, the groove 124 may have a first portion (not shown) with a width sufficient to accommodate the fin in the vertical orientation. A groove 124 second portion (not shown) may have a more narrow height, e.g. a portion wherein the lower surface portion of the groove 124 is raised. In such a configuration, when the fin 132 moves into the groove 124 second portion, the lower portion of the fin 132 would contact the raised lower surface portion of the groove 124. As the work piece 1 continues to move along the bandolier path 51, the fin 132 would cause the work piece 1 to rotate until the fin 132 no longer, or very lightly, engaged the raised lower surface portion of the groove 124. Thus, the orienting structure 120 may be used to rotate the work piece 1 about its longitudinal axis. There may be other orienting devices 122 (not shown) that manipulate the orienting structure 120; for example, a work station 12 may include an actuator (not shown) that extends to contact the orienting structure 120 causing the work piece 1 to rotate about its longitudinal axis.

Further, an orienting device 122 may be structured to laterally adjust the stem 70 within the yoke 40. For example, an actuator (not shown) could engage, e.g. grip or otherwise contact, the orienting structure 120 and moved laterally relative to the longitudinal axis of the bandolier 50. When the actuator engages the stem 70, the stem 70 is moved laterally within the yoke 40.

As noted above, the processing of the single sided work piece 1A is substantially similar to the processing of a dual sided work piece 1, with the notable exception of having work stations 12 structured to act on the blank 68 disposed on only one side of the bandolier 50. Accordingly, the processing steps disclosed above are equally applicable to the single sided work piece 1A.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A method of making products utilizing a progressive die having a plurality of work stations disposed to one side of the path of a bandolier structured to carry a plurality of work pieces, said method comprising the steps of:

a) forming a bandolier from strip material, said bandolier having a plurality of retaining members;

b) inserting a work piece into each retaining member, said work piece having a body having a first end and a medial portion, said first end being a blank that is structured to be acted upon by said work stations, said medial portion being a stem that is structured to support said blank at a location offset and spaced from said bandolier work side and positioned adjacent said work stations;

c) forming said blanks into products; and d) separating said products from said stem.

2. The method of claim 1 wherein said step of inserting a work piece into each retaining member includes the steps of:

feeding a length of wire on to the bandolier; and cutting the wire at an appropriate length.

3. The method of claim 1 wherein said progressive die includes at least one coining station, and wherein said step of forming said blanks into products includes the step of:

coining the blank.

4. The method of claim 3 wherein said progressive die includes at least one cutting station, and wherein said step of forming said blanks into products includes the step of:

removing material from the blank to create a finished product.

5. The method of claim 3 wherein said bandolier is further fed into additional devices structured to perform other processes selected from the group comprising: cleaning, coating, and heat treating.

* * * * *

UNITED STATES PATENT AND TRADEMARK OFFICE

CERTIFICATE OF CORRECTION

PATENT NO. : 8,539,808 B2
APPLICATION NO. : 13/366570
DATED : September 24, 2013
INVENTOR(S) : D. Patrick Jones et al.

It is certified that error appears in the above-identified patent and that said Letters Patent is hereby corrected as shown below:

In the Drawings:
Figure 5, line 4, “laterial” should read --lateral--.

In the Specification:
Column 2, line 32, “extended further” should read --extends further--.
Column 3, line 44, “FIG. 3 a top” should read --FIG. 3 is a top--.
Column 8, line 1, “first end has one configuration” should read --has one configuration--.
Column 8, line 64, “and structured” should read --and is structured--.
Column 10, line 57, “and moved” should read --and move--.

Signed and Sealed this
Seventeenth Day of June, 2014

Michelle K. Lee

Michelle K. Lee
*Deputy Director of the United States Patent and Trademark Office*